US010393141B2

(12) United States Patent
Fong et al.

(10) Patent No.: US 10,393,141 B2
(45) Date of Patent: Aug. 27, 2019

(54) GAS INJECTION BLOWER

(71) Applicant: ORIENT SERVICE CO., LTD., Taipei (TW)

(72) Inventors: Wu-Yu Fong, Taipei (TW); Zih-Ci Liou, Taipei (TW); Jhih-Hao Jhang, Taipei (TW)

(73) Assignee: ORIENT SERVICE CO., LTD., Taipei (TW)

( * ) Notice: Subject to any disclaimer, the term of this patent is extended or adjusted under 35 U.S.C. 154(b) by 203 days.

(21) Appl. No.: 15/285,604

(22) Filed: Oct. 5, 2016

(65) Prior Publication Data

US 2018/0017072 A1 Jan. 18, 2018

(30) Foreign Application Priority Data

Jul. 18, 2016 (TW) ..... 105122616 A

(51) Int. Cl.
*F04D 29/42* (2006.01)
*F04D 7/06* (2006.01)
(Continued)

(52) U.S. Cl.
CPC ..... *F04D 29/4206* (2013.01); *F04D 7/06* (2013.01); *F04D 29/023* (2013.01);
(Continued)

(58) Field of Classification Search
CPC .. F04D 29/4206; F04D 29/023; F04D 29/053; F04D 29/281; F04D 29/701;
(Continued)

(56) References Cited

U.S. PATENT DOCUMENTS 2,300,721 A * 11/1942 Young ..... F04D 15/0055 415/129
2,772,925 A * 12/1956 Dygert ..... B01J 8/1872 406/193
(Continued)

FOREIGN PATENT DOCUMENTS

JP 07167086 A * 7/1995
JP H10-026005 A * 1/1998
JP 2012077642 A * 4/2012

*Primary Examiner* — Justin D Seabe
*Assistant Examiner* — Topaz L. Elliott
(74) *Attorney, Agent, or Firm* — Chun-Ming Shih

(57) ABSTRACT

A gas injection blower includes a housing forming a box around the pump chamber, wherein the perimeter of the housing is also formed with a pump chamber communicating air inlet and an exhaust outlet, a fan shaft connected to a drive shaft the form of a rotatable type arranged in the pump chamber, the air inlet, forming a pressurized chamber of the pump flow passage between the fan and air vents and communicate with each other, the drive shaft extending through the shaft connected to a pump outdoor power source, wherein the drive shaft, at least between the inner wall of the frame around the blades and the pump chamber is formed a slit communicating the boost pressure drop of the flow channel, which is housing and forming a gap communicating the pressure drop gas injection passage; with the passage of gas injected into the inner injection cleaning gas pressure, to improve the traditional drop relatively easy accumulation of dust inside the gap problem.

9 Claims, 5 Drawing Sheets

(51) Int. Cl.
*F04D 29/02* (2006.01)
*F04D 29/70* (2006.01)

(52) U.S. Cl.
CPC ..... *F04D 29/4226* (2013.01); *F04D 29/701* (2013.01); *F04D 29/705* (2013.01)

(58) Field of Classification Search
CPC ..... F04D 29/28; F04D 29/38; F04D 29/70; F04B 17/00
USPC ..... 415/203; 96/243
See application file for complete search history.

(56) References Cited

U.S. PATENT DOCUMENTS 3,452,679 A * 7/1969 Skinner ..... F04D 29/708 415/112
4,893,995 A * 1/1990 Hufstader ..... F04D 25/082 415/169.1
4,958,988 A * 9/1990 Regev ..... F04D 7/06 417/366
5,344,678 A * 9/1994 Kajiwara ..... F04D 1/063 138/140
5,900,047 A * 5/1999 Rodriguez ..... H01L 21/67017 438/905
5,980,207 A * 11/1999 Correll ..... F04D 29/023 416/186 R
8,052,376 B2 * 11/2011 Yamawaku ..... F04D 19/042 415/90
2011/0076133 A1 * 3/2011 Agneray ..... F04D 29/684 415/115
2013/0287875 A1 * 10/2013 Yoshimi ..... B29D 30/0662 425/44
2014/0322019 A1 * 10/2014 Husted ..... F01D 5/282 416/170 R
2015/0211379 A1 * 7/2015 Doumecq-Lacoste ..... F01D 21/003 415/1
2015/0345515 A1 * 12/2015 Isogai ..... F04D 29/701 415/115

* cited by examiner

GAS INJECTION BLOWER

TECHNICAL FIELD

The present invention relates to a structure of a blower, particularly to a gas injection blower.

BACKGROUND OF THE INVENTION

The blower is an equipment which uses fan blades of a pump chamber of a motor-driven pump to rotate, thereby generating a suction airflow. In general, the blower has been widely used in a gas blowing equipment or a gas suction equipment to produce a forced convection gas flow.

Furthermore, a pump chamber of the blower is formed by a device housing. The device housing has an air inlet and an air discharge aperture. By the blower motor attached to blower (or the so-called motor) or an external power source, fan blades are driven in the pump chamber to rotate to force the outside atmosphere air move in from the air inlet or to drive the gas in an air extraction equipment to move into the pump chamber, and through the operation of the fan blades the air in the pump chamber will be pushed to the air discharge aperture and be discharged out of the pump chamber. Therefore the needed air is forced to be supplied to the required gas blower device or to external outside in order to achieve the purpose of forcing a configuration convection gas.

From the foregoing, when the fan blades of the blower are in operation, an air pressurized flow channel will be formed at the pump chamber located between the air inlet and the air discharge aperture for delivery of pressurized gas to the air discharge aperture. A pressure drop is easily formed in the pump chamber located between the rear surface of the fan blades and the narrower space adjacent to the drive shaft connected to the shaft portion (hereinafter referred to as the depressurization slot), because it located at relative deviation position from the air pressurized flow channel between the air inlet and the air discharge aperture. Thus, the accumulation of the gas entrained dust or dirt in association with the air can be easily formed in the depressurization slot, and the blower must often be washed or maintained to eliminate the dust or dirt in the depressurization slot.

The gas generally contains an atmospheric air, or a process gas used in the industrial equipment or special process. It is selected according to the place of assembly or according to its equipment application of the blower assembly equipment.

Since most of the general blowers are made of metallic materials. Because the different types of gas are transported by the blower, particularly when the gas is a gas having an acidic or alkaline or corrosive property, the accumulated dust or dirt accumulated in the depressurization slot have corrosive or toxic property to affect the service life of the blades, the drive shaft, the pump chamber walls and other components.

For example, as shown in rear stage washing process in a semiconductor process equipment (scrubber), it is necessary to form a negative pressure in the reaction chamber of the washing process equipment so as to let the process exhaust gases smoothly pass through the water washing and to be pulled to the outside of the reaction chamber. The acidic alkaline dust, dirt or water mist generated in the water washing of the process exhaust gases will be easily accumulated in the pump chamber of the blower, especially in the depressurization slot of the pump chamber, resulting in corrosion of the blades, the drive shaft, the pump chamber walls and other components, and even affect the life of the blower.

SUMMARY OF THE INVENTION

In view of this, an object of the present invention is aimed at improving the problems of easy accommodation of dust or dirt in the depressurization slot of a traditional blower pump chamber.

To solve the above problems, the present invention provides a gas injection blower comprising:

a device housing having a pump chamber formed around the pump chamber, an air inlet, an air discharge aperture and a shaft hole fluidly connected to the pump chamber being respectively formed at a perimeter of the device housing; and a fan blade for pivotally connecting to a driving shaft and rotationally arranged in the pump chamber, a pressurized flow channel located in the pump chamber being formed between the air inlet, the air discharge aperture and the fan blade fluidly connected therebetween, the shaft hole being pivotally connected to the driving shaft, and the driving shaft extending and protruding to an outside of the pump chamber via a shaft hole for pivotally connecting to a power source, wherein a depressurization slot for fluidly connecting to the pressurized flow channel is surrounded and formed between the driving shaft, the fan blade and an inner wall of the pump chamber, a gas injection passage for fluidly connecting to the depressurization slot is formed in the device housing.

In a further embodiment of the present invention, a shaft sleeve is preferably mounted on the driving shaft, and the driving shaft is pivotally connected to the shaft hole via the shaft sleeve.

According to the present invention, the depressurization slot preferably comprises a space surrounded by a hole wall formed in the shaft hole, an outer wall of the shaft sleeve, an inner wall of the pump chamber and a rear surface of the fan blade.

According to the present invention, the inner wall of the pump chamber preferably comprises a disk-shaped inner wall, and the disk-shaped inner wall is spaced apart from and correspondent to the rear surface of the fan blade via the depressurization slot.

According to the present invention, preferably the inner wall of the pump chamber further comprises an annular inner wall formed at a perimeter of the disk-shaped inner wall, an annular gap is maintained between the annular inner wall and the fan blade, and the annular gap is in communication between the depressurization slot and the air discharge aperture.

According to the present invention, the gas injection passage is preferably fluidly connected to the depressurization slot via the shaft hole.

According to the present invention, preferably the inner wall of the pump chamber comprises a disk-shaped inner wall, the disk-shaped inner wall is spaced apart from and correspondent to the rear surface of the fan blade via the depressurization slot, the disk-shaped inner wall is fixed to an outer wall of a separating board in the pump chamber and the gas injection passage is formed by separating a housing wall of the device housing from the separating board.

According to the present invention, a descaling gas is preferably injected into the gas injection passage, the descaling gas sequentially moves through and the depressurization slot and the pressurized flow channel to be discharged from the air discharge aperture.

According to the present invention, preferably a gas injection connector for fluidly connected to the gas injection passage is disposed at an end side of the device housing side, and the descaling gas is guided by the gas injection connector to move into the depressurization slot via the gas injection passage.

According to the present invention, preferably the descaling gas is air.

According to the present invention, preferably the descaling gas is nitrogen, and the gas injection blower is an exhaust blower used in a semiconductor waste gas treatment equipment.

In addition to the above descriptions, another object of the present invention is to further improve the conventional problems of corrosion by acid or alkaline dirt during transportation of the semiconductor manufacturing process waste gas. To solve this problem, the present invention provides a gas injection blower in which preferably the device housing and the fan blade are made from a corrosion resistance plastic material.

According to the above aspect, the technical effects of the present invention are as follows: This invention can regularly supply the descaling gas to the depressurization slot to blow accumulated dust, to reduce the amount or times of maintenance or repairs of the washable blower and to help to extend the life of the blower.

When the gas transported by the blower contains acidic or alkaline mist or dust, nitrogen can be used as the descaling gas. In addition to the blowing of the accumulated acidic or alkaline dirt in the depressurization slot, because nitrogen will not easily chemically react with acidic or alkaline chemicals, this invention can effectively dilute acid or alkali concentration, improve the problem say that the inner wall surrounding the pump chamber, the driving shafts, the fan blades and other parts are susceptible to acid or alkali erosion, thereby reducing the needed amount or times of maintenance or repairs of the washable blower and to help to extend the life of the blower.

For techniques described above and the resulting performance of the specific implementation details, please refer to the following examples and drawings in the described embodiments.

BRIEF DESCRIPTION

DETAILED DESCRIPTION OF THE INVENTION

Figure 1:
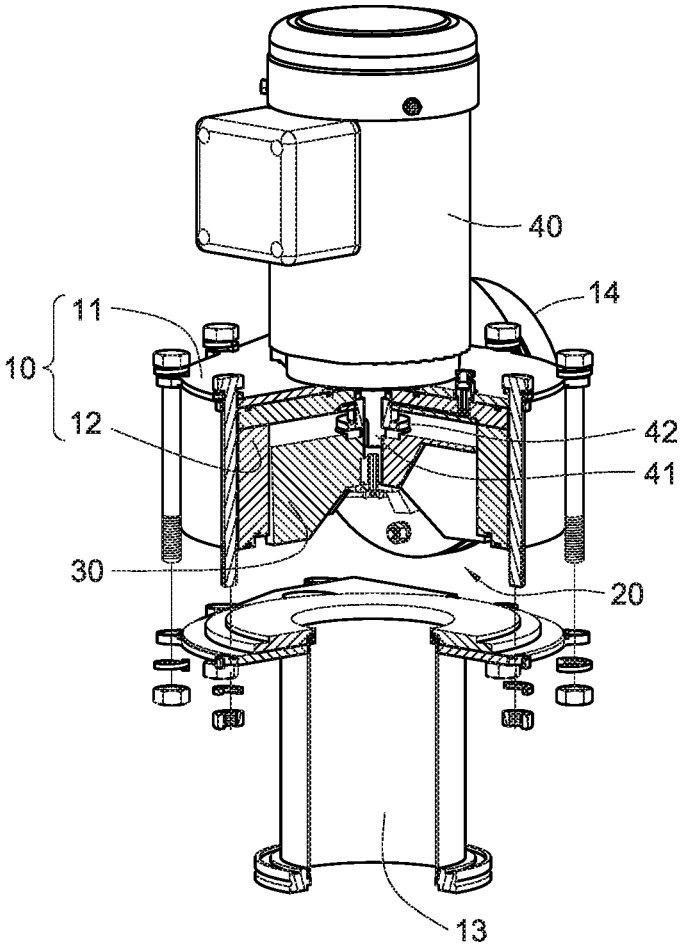
FIG. 1 is an exploded perspective view of the air injection blower of the present invention.
Figure 2:
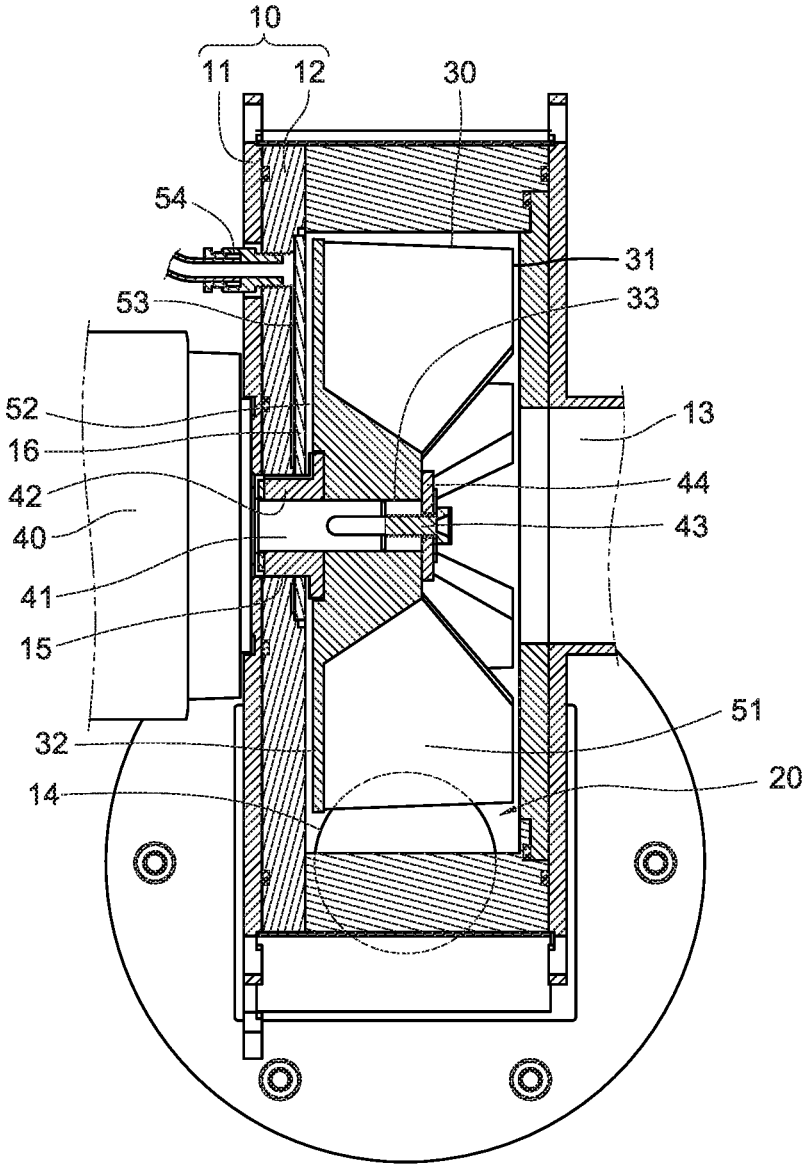
FIG. 2 is a configurational cross-sectional diagram of the members shown in FIG. 1.
Figure 3:
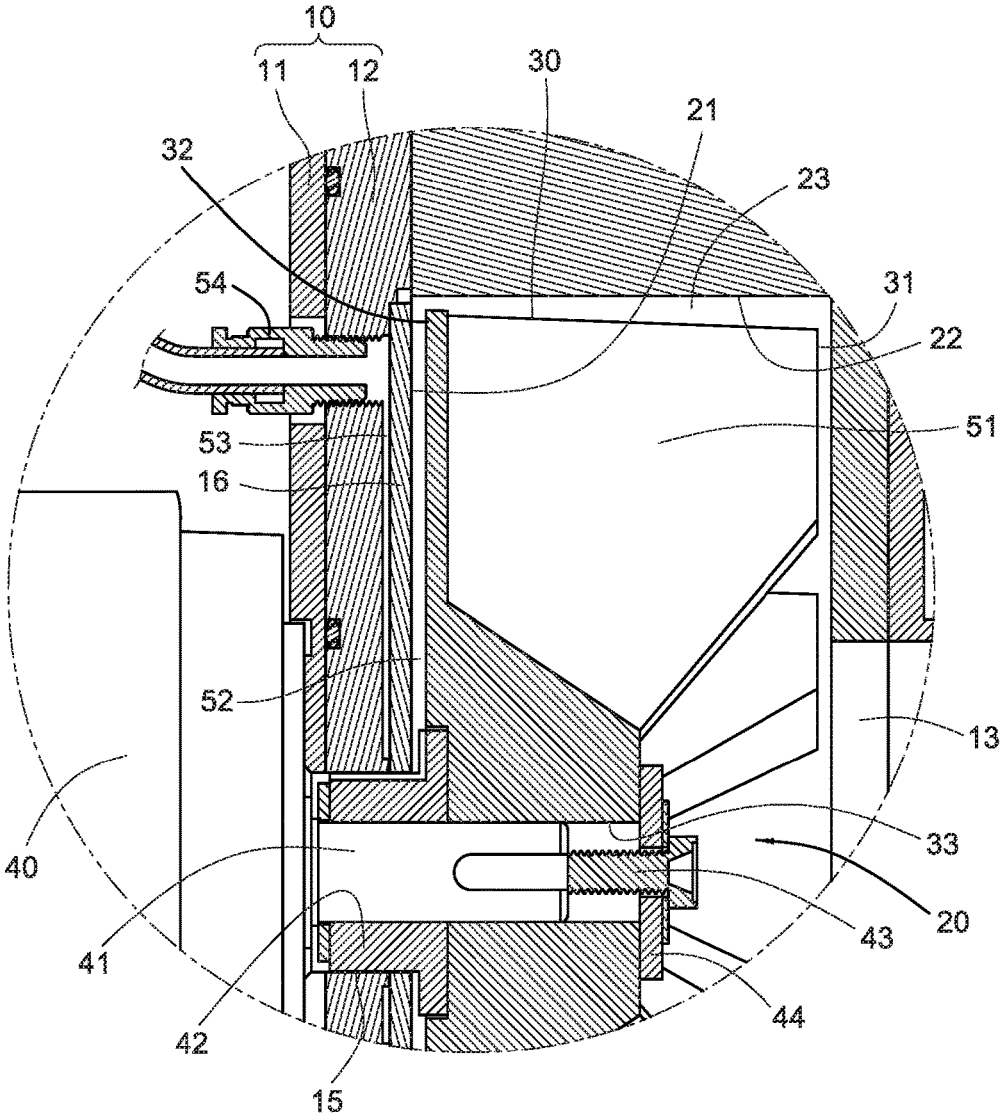
FIG. 3 is a partially enlarged cross-sectional diagram of FIG. 2.

Firstly, please refer to the FIGS. 1 to 3 illustrating a preferred embodiment of the present invention, the gas injection blower of the present invention comprises a device housing 10 and a fan blade 30.

The device housing 10 has a cylindrical pump chamber 20 formed inside the device housing 10. At the perimeter of the device housing 10, an air inlet 13, an air discharge aperture 14 and a shaft hole 15 for fluidly connecting to a pump chamber 20 are formed. The device housing 10 includes an outer housing 11 and an inner housing 12. The outer housing 11 is made of stainless steel, and the inner housing 12 is made of acid and alkali erosion-resistant plastic material. In addition to increasing structure intensity of the device housing 10, the vulnerable acid or alkali erosion problem of the device housing 10 is improved.

The fan blade 30 is disposed in the pump chamber 20. The fan blade 30 is made of acid and alkali erosion-resistant plastic material. The fan blade 30 includes a plurality of blades spaced apart in radial configuration. In the present invention, the fan blades 30 are defined as ones that the front surface 31 of the fan blade 30 is the end surface faced toward the direction of the air inlet 13 of the blades 30.

The fan blade 30 in the embodiment is pivotally connected to the driving shaft 41 via a shaft hole 15 so that the fan blade 30 can be configured to be rotationally arranged in the pump chamber 20. Furthermore, the driving shaft 41 extends through the shaft hole 15 to be outside of the pump chamber 20 via the shaft hole 15 and pivotally connected to a power source. The power source 40 may be a motor (or motors) in the implementation, or made by the other machine to provide a rotational force. More specifically, the center axis of the fan blade 30 has an axis hole 33. The driving shaft 41 is assembled to the axis hole 33. The fan blade 30 is fastened and locked by the screw 43 and the pad 44 located at one end of the driving shaft 41, thereby enabling the fan blade 30 can be connected to the driving shaft 41 to show a rotatable configuration in the pump chamber 20. In the present invention, an end surface of the fan blade 30 faced toward the direction of the power source 40 is defined as a rear surface 32 of the fan blade 30.

In the specific embodiment, a pressurized flow channel 51 located in the pump chamber 20 is formed between the air inlet 13, the fan blade 30 and the air discharge aperture 14. By virtue of the pressurized flow channel 51, the air inlet 13, the fan blade 30 and the air discharge aperture 14 are fluidly connected mutually. The power source 40 is used to drive the fan blade 30 to rotate in the pump chamber 20 in order to retrieve external air from the air inlet 13 or to force gas in the blower device to move into the pressurized flow channel 51 of the pump chamber 20. The air in the pressurized flow channel 51 is forced to move by the rotational operation of the fan blades 30 to the air discharge aperture 14 and is discharged from the pump chamber 20. Thus, the air is forced to be supplied into the blower equipment or to the outside to achieve mandatory convection gas configuration purpose.

From the foregoing, a depressurization slot 52 is formed in a narrow space located in the pump chamber 20 between the rear surface 32 of the fan blade 30 and the location adjacent to the shaft portion of the driving shaft 41 in order to easily form a pressure drop. Because a gas pressure in the depressurization slot 52 is smaller than that in the pressurized flow channel 51, the accumulation of the gas entrained dust or dirt easily occur in the depressurization slot 52, which lead to that the blower must often be washed or be maintained to eliminate the dust or dirt in the depressurization slot 52.

Figure 4:
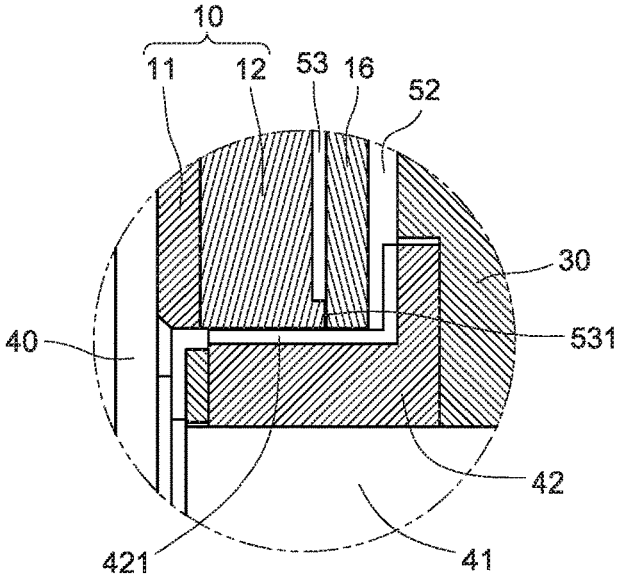
FIG. 4 is a partially enlarged cross-sectional diagram of FIG. 3.

Please refer to FIGS. 2 to 4 illustrating a shaft sleeve 42 is fixed on the driving shaft 41 in the described embodiment. The driving shaft 41 is pivotally connected to the shaft hole 15. In more details, the depressurization slot 52 contains a space surrounded and formed by the hole wall of the shaft hole 15, the outer wall of the shaft sleeve 42, the inner wall of the pump chamber 20 and the rear surface 32 of the fan blade 30. Moreover, a gas guiding trench 421 is formed on a surface of the shaft sleeve 42. The dust or dirt is guided by the gas guiding trench 421 to smoothly move into the depressurization slot 52. A fixed gap for avoiding friction between the fan blade 30 and the inner wall of the pump chamber 20 during rotation is formed between the rear surface 32 of the fan blade 30 and the inner wall of the pump chamber 20 by the shaft sleeve 42.

Figure 5:
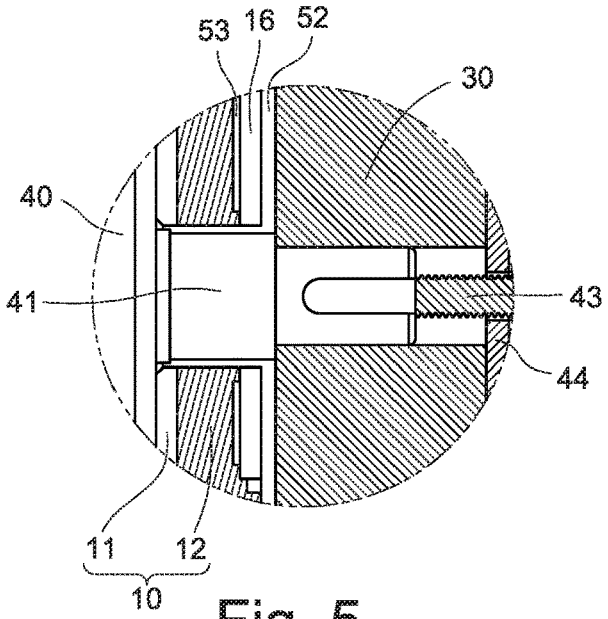
FIG. 5 is a schematic diagram showing the construction of another embodiment of the driving shaft of the present invention.

Please refer to FIG. 5 which illustrates the driving shaft 41 in the embodiment may be designed as a T-shape body so that when the fan blade 30 is pivotally attached to the driving shaft 41, the gap is maintained between the rear surface 32 of the fan blade 30 and the inner wall of the pump chamber 20 to avoid friction between the fan blade 30 and the inner wall of the pump chamber 20 during rotation.

Please refer to FIGS. 3 and 4 indicating that a gas injection passage 53 for fluidly connecting to the depressurization slot 52 is formed in the device housing 10. The gas injection passage 53 in the embodiment is connected to the depressurization slot 52 to form a channel port 531. The descaling gas in the gas injection passage 53 moves into the depressurization slot 52 via the channel port 531. The cross-sectional area of the channel port 531 is smaller than the cross-sectional area of the gas injection passage 53 so as to enhance the flow rate of the descaling gas and to strengthen the cleaning effect of blowing the dust or dirt by the descaling gas. More specifically, the descaling gas is injected by high-pressure gas into the gas injection passage 53 through which the descaling gas sequentially moves through the depressurization slot 52 and the pressurized flow channel 51 and is discharged from the air discharge aperture 14, so that the accumulated internal acid or alkali dust in the depressurization slot 52 was blown off the depressurization slot 52 by the descaling gas. The descaling gas may blow off the acid or alkali dust from the depressurization slot 52 to move into the pressurized flow channel 51 so that they in association with the gas transported in the pressurized flow channel 51 are discharged from the air discharge aperture 14.

In the specific embodiment, not only the descaling gas can blow off the dust or the dirt from the depressurization slot 52, but also the gas pressure in the depressurization slot 52 is larger than that in the pressurized flow channel 51 by means of the descaling gas to be fully filled into the depressurization slot 52, thereby avoiding the gas entrained dust or dirt to move into the depressurization slot 52 by a pressure drop phenomenon. The blower can reduce the amount and times of required maintenance or washing, and helps to extend the durability and the life of the blower.

The descaling gas in its implementation may be air or nitrogen. When the descaling gas is nitrogen, since nitrogen will not easily react with acidic or alkaline chemicals, it can effectively dilute the concentration of the acid or alkali dirt and improves the problem of acid or alkali erosion between the inner wall of the pump chamber 20, the driving shaft 41, the fan blade 30 and other parts at a periphery of the depressurization slot 52.

Please refer to FIG. 3 illustrating in the embodiment the inner wall of the pump chamber 20 comprises a disk-shaped inner wall 21. The shaft hole 15 is formed on the disk-shaped inner wall 21. The disk-shaped inner wall 21 is spaced apart and corresponding to the rear surface 32 of the fan blade 30 by the depressurization slot 52. Moreover, the inner wall of the pump chamber 20 comprises an annular inner wall 22 formed around the disk-shaped inner wall 21. An annular gap 23 is formed between the fan blade 30 and the annular inner wall 22. The annular gap 23 is fluidly connected between the depressurization slot 52 and the air discharge aperture 14. More specifically, the annular gap 23 is fluidly connected to the pressurized flow channel 51 so that the depressurization slot 52 is fluidly connected to the pressurized flow channel 51 via the annular gap 23. The annular gap 23 in the implementation can be regarded as a part of the pressurized flow channel 51.

Please refer to the FIGS. 2 to 4 indicating that the disc-shaped inner wall 21 in the embodiment is an outer wall of the separating board 16 fixed to the pump chamber 20. The gas injection passage 53 is formed by separating a case (inner housing 12) of the device housing 10 from the separating board 16. Moreover, at an end side of the device housing 10, a gas injection connector 54 for fluidly connecting to the gas injection passage 53 is provided. The gas injection connector 54 guides the descaling gas to move into the depressurization slot 52 via the gas injection passage 53. In addition, the gas injection connector 54 can be mounted by an additional valve controlled external piping (not shown) for controlling the timing of injecting the descaling gas. For example, descaling gas blower operation is operated by continuous injection or by intermittent injection.

Figure 6:
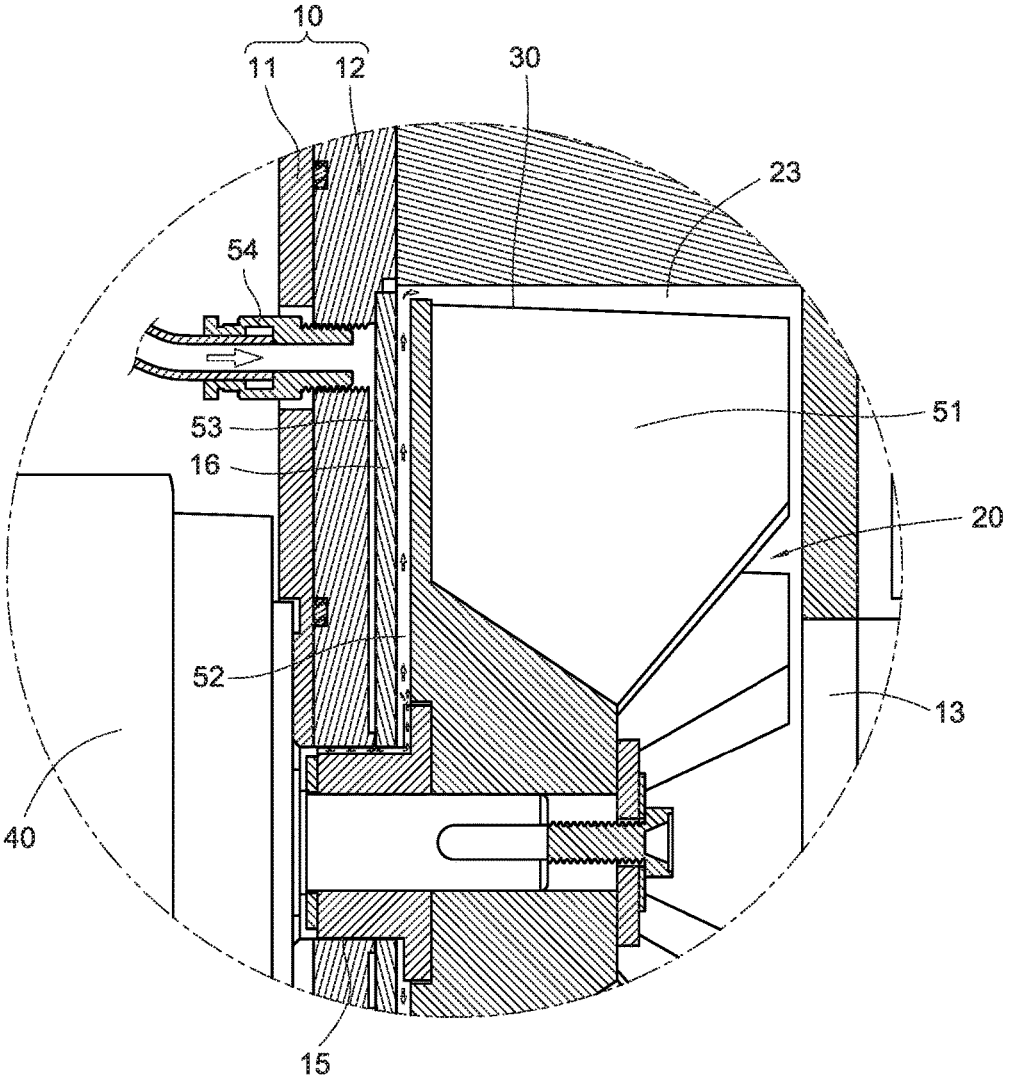
FIG. 6 is a schematic diagram of the flow path of the descaling gas in FIG. 3.

Please refer to FIG. 6 indicating the descaling gas is guided by the gas injection connector 54 to move through the gas injection passage 53 and to move into the depressurization slot 52. With the descaling gas to blow off the accumulated dust or dirt from the depressurization slot 52, the dust or dirt is blow from the depressurization slot 52 into the pressurized flow channel 51. The dust or dirt in association with the gas carried in the pressurized flow channel 51 is discharged out of the air discharge aperture 14.

The above examples are merely the expression of a preferred embodiment of the present invention, but it can not therefore be construed as limiting the scope of the present invention patent.

We claim:

1. A gas injection blower comprising:

a device housing having a pump chamber formed therein, an air inlet, an air discharge aperture and a shaft hole each fluidly connected to the pump chamber and formed at a perimeter of the device housing; and a fan blade connected to a driving shaft and rotationally arranged in the pump chamber, a pressurized flow channel located in the pump chamber being formed among the air inlet, the air discharge aperture and the fan blade and fluidly connected therebetween, the shaft hole being pivotally connected to the driving shaft, and the driving shaft extending and protruding to an outside of the pump chamber via the shaft hole for pivotally connecting to a power source, the power source driving the fan blade to rotate in the pump chamber to retrieve an external air from the air inlet, and the external air entering the pressurized flow channel being discharged from the air discharge aperture;

wherein a depressurization slot for fluidly connecting to the pressurized flow channel is formed among the driving shaft, the fan blade and an inner wall of the pump chamber, a gas injection passage for fluidly connecting to the depressurization slot is formed in the device housing;

wherein a descaling gas is injected into the gas injection passage, the descaling gas sequentially moves through the depressurization slot and the pressurized flow channel to be discharged from the air discharge aperture;

wherein a pressure of the descaling gas in the depressurization slot is larger than a pressure of the external air in the pressurized flow channel; and wherein the inner wall of the pump chamber comprises a disk-shaped inner wall, the disk-shaped inner wall is spaced apart from and correspondent to a rear surface of the fan blade via the depressurization slot, the disk-shaped inner wall is fixed to an outer wall of a separating board in the pump chamber and the gas injection passage is formed by separating a housing wall of the device housing from the separating board.

2. The gas injection blower as claimed in claim 1, wherein a shaft sleeve is mounted on the driving shaft, and the driving shaft is pivotally connected to the shaft hole via the shaft sleeve.

3. The gas injection blower as claimed in claim 2, wherein the depressurization slot comprises a space surrounded by a hole wall formed in the shaft hole, an outer wall of the shaft sleeve, the inner wall of the pump chamber and the rear surface of the fan blade.

4. The gas injection blower as claimed in claim 1, wherein the inner wall of the pump chamber further comprises an annular inner wall formed at a perimeter of the disk-shaped inner wall, an annular gap is maintained between the annular inner wall and the fan blade, and the annular gap is in communication between the depressurization slot and the air discharge aperture.

5. The gas injection blower as claimed in claim 1, wherein the gas injection passage is fluidly connected to the depressurization slot via the shaft hole.

6. The gas injection blower as claimed in claim 1, wherein a gas injection connector fluidly connected to the gas injection passage is disposed at an end side of the device housing side, and the descaling gas is guided by the gas injection connector to move into the depressurization slot via the gas injection passage.

7. The gas injection blower as claimed in claim 1, wherein the descaling gas is air.

8. The gas injection blower as claimed in claim 1, wherein the descaling gas is nitrogen, and the gas injection blower is an exhaust blower used in a semiconductor waste gas treatment equipment.

9. The gas injection blower as claimed in claim 8, wherein the device housing and the fan blade are made from a corrosion resistant plastic material.

* * * * *